United States Patent [19]

Morrison

[11] Patent Number: 4,722,638

[45] Date of Patent: Feb. 2, 1988

[54] SCREEN WITH FRONTAL DISTRIBUTION UNIT

[76] Inventor: Donald R. Morrison, 6228 Eagle Peak Dr., Charlotte, N.C. 28214

[21] Appl. No.: 6,508

[22] Filed: Jan. 22, 1987

[51] Int. Cl.[4] ..... E01C 19/22

[52] U.S. Cl. ..... 404/119; 404/114

[58] Field of Search ..... 404/101, 103, 114, 118, 404/119, 120; 425/456

[56] References Cited

U.S. PATENT DOCUMENTS

| | | | |
|---|---|---|---|
| 2,133,862 | 10/1938 | Kerns | 404/117 |
| 2,219,246 | 10/1940 | Jackson | 404/114 |
| 2,219,247 | 10/1940 | Jackson | 404/114 |
| 2,248,247 | 7/1941 | Nichols | 404/120 |
| 3,087,394 | 4/1963 | Barnes | 404/114 |
| 3,402,649 | 9/1968 | Guntert | 404/118 X |
| 3,515,043 | 6/1970 | Austin | 404/103 |
| 3,547,014 | 12/1970 | Austin | 404/117 |
| 3,797,953 | 3/1974 | Lindskog | 404/103 |
| 4,030,873 | 6/1977 | Morrison | 404/114 X |
| 4,213,749 | 7/1980 | Morrison | 425/456 |
| 4,249,327 | 2/1981 | Allen | 404/114 |
| 4,466,757 | 8/1984 | Allen | 404/114 |

FOREIGN PATENT DOCUMENTS

| | | | |
|---|---|---|---|
| 0000160 | 2/1980 | World Int. Prop. O. | 404/118 |

*Primary Examiner*—Stephen J. Novosad
*Assistant Examiner*—John F. Letchford
*Attorney, Agent, or Firm*—Steven J. Hultquist; B. B. Olive

[57] ABSTRACT

A concrete screed comprising an elongate frame with a first longitudinally extending screed plate connected to a leading portion of the frame, and a second longitudinally extending screed plate connected to the frame rearwardly of the first screed plate. A plow body is mounted on the frame in close proximity to the first screed plate and presents discrete surface portions, comprising: (i) a first generally horizontal surface portion, extending forwardly from the vicinity of the first screed plate to a front leading edge and generally horizontally aligned with the first screed plate, and (ii) a second surface portion integrally joined to the front leading edge of the first surface portion and extending upwardly therefrom to an upper edge. Means are coupled to the frame for translating it along concrete to be screeded, whereby the first and second screed plates and plow body are brought into operative screeding engagement with the concrete.

Means for maintaining longitudinal alignment of the frame during the screeding operation are also disclosed.

5 Claims, 6 Drawing Figures

SCREEN WITH FRONTAL DISTRIBUTION UNIT

BACKGROUND OF THE INVENTION

1. Field of the Invention

This invention relates to concrete screeds of a type providing plural screed surfaces.

2. Description of the Related Art

Applicant's prior U.S. Pat. No. 4,030,873 discloses a portable screed incorporating a motor-driven vibrating shaft within a lightweight open structural frame. A winching mechanism for a vibrating shaft type screed is described in applicant's prior U.S. Pat. No. 4,253,778.

Another type of screed employs a roller which is rotated in a direction opposite to the direction of travel and screeds the concrete by moving the roller over freshly poured concrete in front of the roller. One such motor-driven screed roller is the Razor Back Roller Finisher sold by Allen Engineering Corporation of Paragould, Ariz. A similar type of roller screed identified as the Hurricane screed is sold by C & S Manufacturing Company of Tulsa, Okla.

The roller type screed has a number of advantages particularly in application to screeding concrete on slopes and grades, but has the disadvantage of not consolidating concrete as effectively as does a vibrating frame type screed. In addition, when roller screeds are provided in extended lengths, above about 25 feet, deflection of the roller element is encountered, which adversely affects the profile of the concrete being screeded in many applications, or alternatively requires the fabrication of the roller element with a thick-walled structure to resist the deflection.

In an attempt to overcome the deficiencies of the roller type screeds while realizing the benefits associated with vibrating frame type screeds, applicant's copending U.S. patent application Ser. No. 936,480 filed Nov. 26, 1986, and entitled "Multi-Section Screed Roller Apparatus", proposes an improved screed comprising an open multi-section frame on the front of which is mounted a motor-driven multi-section screed roller, and behind which is provided a pair of screed plates. On the rear of this screed is provided a driven vibrating shaft which extends lengthwise of the screed to induce vibrations primarily in the trailing portions of the screed for consolidation of the concrete after it has been roughly screeded and graded by the multi-section roller. This apparatus further includes means for winching the screed in the direction of travel, and incorporates a turnbuckle arrangement compensating for any tendency of the multi-section roller to deflect when the screed length is relatively long.

While the screed roller apparatus of the aforementioned Ser. No. 936,480 application incorporates a number of advantageous features of roller screeds and vibrating frame type screeds, in applications where very wet concrete is being screeded, the rough screeding, grading and distributing functions of the roller are not fully optimally achieved.

Accordingly, there exists a continuing need for an improved screed apparatus utilizing auxiliary means for preliminary rough screeding, grading and distributing of the concrete prior to final screeding and consolidation by the apparatus.

It is therefore an object of the present invention to provide an improved screeding apparatus of the aforementioned type, which provides a high degree of screeding efficiency, including concrete distribution and consolidation prior to final, i.e., finishing, screeding action.

Other objects and advantages of the present invention will be more fully apparent from the ensuing disclosure and appended claims.

SUMMARY OF THE INVENTION

In one aspect, the present invention relates to a concrete screed, comprising:

(a) an elongate frame;

(b) a first screed plate extending lengthwise of the frame and connected to a leading portion of the frame;

(c) a second screed plate extending lengthwise of the frame and connected to the frame rearwardly of the first screed plate;

(d) a plow body mounted on the frame to be in close proximity to the first screed plate and presenting discrete surface portions each longitudinally extending for at least a major portion of the frame length, the discrete surface portions comprising:

(i) a first generally horizontal surface portion, extending forwardly from the vicinity of the first screed plate to a front leading edge and generally horizontally aligned with the first screed plate;

(ii) a second surface portion integrally joined to the front leading edge of the first surface portion and extending upwardly therefrom to an upper edge;

(e) means coupled to the frame for translating such frame along concrete to be screeded, whereby the first and second screed plates and the plow body are engagable in operative screeding contact with the concrete.

In another aspect, the concrete screed as broadly described above may additionally comprise vibrator means mounted on the frame and operative to vibrate at least trailing portions of the frame during use, to effect consolidation of the concrete after it is engaged by the plow body and first screed plate. Such vibration-imparting means may suitably comprise a loose bearing or other vibrating shaft arrangement as disclosed in applicant's aforementioned issued U.S. patents and copending application.

In a further aspect, the concrete screed as broadly described above may be constructed with a frame having an open structure and comprising a plurality of interconnected separable frame units, with such frame units being connectable by adjustable connector means, to place adjacent frame units in selected attitude relationships with respect to one another.

Another aspect of the invention relates to a concrete screed constructed with a frame having an open structure and comprising plural interconnected separable frame units, and means for maintaining longitudinal alignment of the multi-unit frame. The screed comprises first and second cables, each of which is associated with and extends forwardly from respective first and second ends of the frame, for drawing the screed in a selected direction generally perpendicular to the longitudinal axis of the screed frame. The first cable extending frowardly from the first end of the frame passes lengthwise of the frame at its trailing portion and is connected to the second end of the frame. Adjustable tensioning means are provided at an intermediate portion of the frame and coupled with such first cable to impart a selected tension thereto, whereby the multi-unit frame is maintained in a selected longitudinal alignment.

Other features and elements of the invention will be more fully apparent from the ensuing disclosure and appended claims.

DETAILED DESCRIPTION OF THE INVENTION, AND PREFERRED EMBODIMENTS THEREOF

Figure 1:
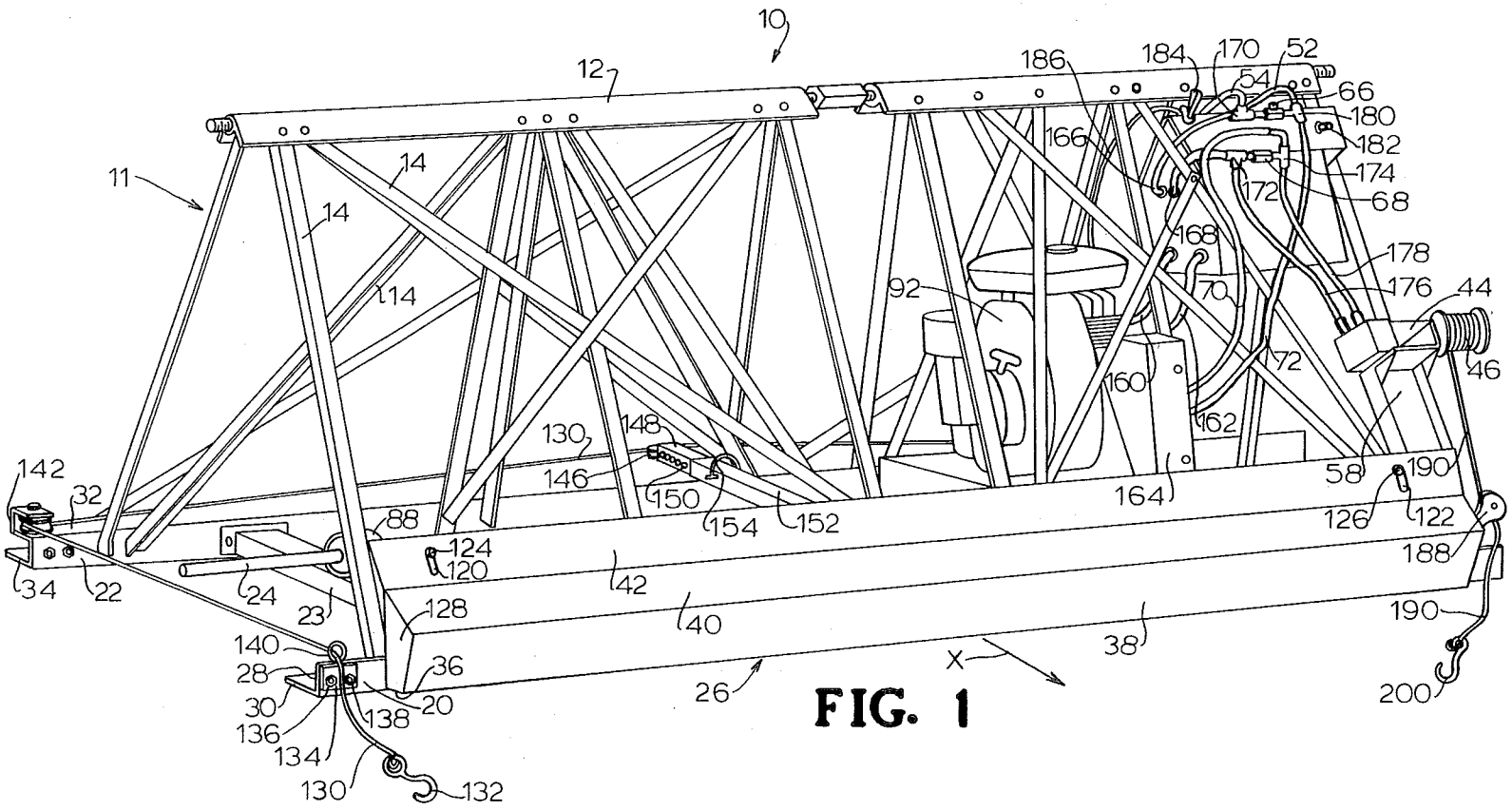
FIG. 1 is a front perspective view of a screed apparatus according to one embodiment of the present invention.
Figure 2:
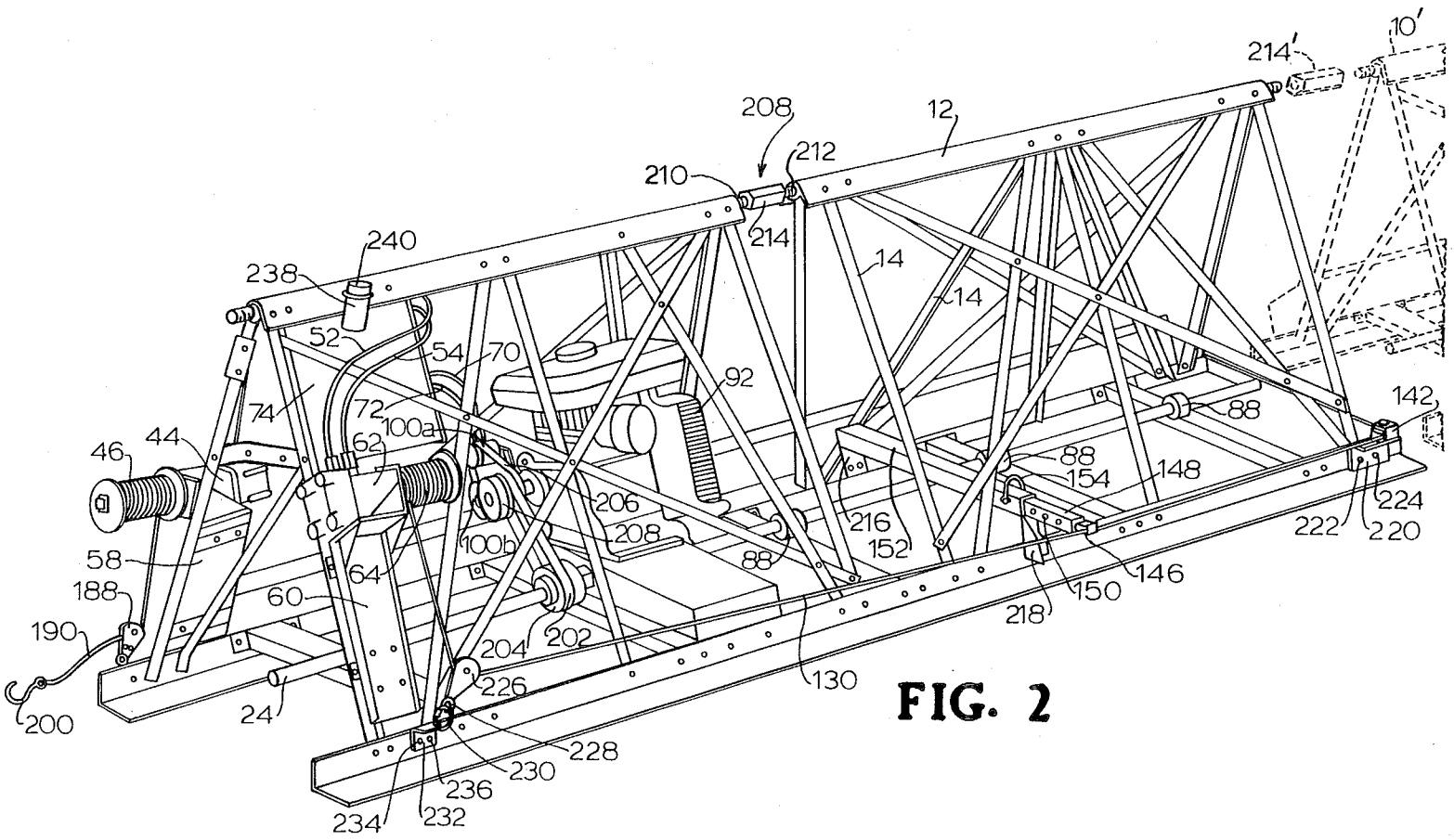
FIG. 2 is a rear perspective view of the acreed apparatus of FIG. 1, showing the optional attachment of an extention frame unit thereto, whereby the length of the screed apparatus may be increased to a desired extent.

Referring now to the drawings, FIGS. 1 and 2 show respective front and rear perspective views of a screed apparatus according to one embodiment of the invention, in which the same apparatus elements are identically numbered in each drawing.

The screed apparatus 10 comprises an open structural frame 11 including various braces 14 joining the first screed blade 20 and second screed blade 22 to a longitudinally extending camber top member 12 as shown, whereby the frame has the triangular shape in cross-section shown in FIGS. 1 and 2. The various support braces 14 may be joined to the respective camber top member 12 and first screed blade 20 or second screed blade 22 by any suitable means, e.g., mechanical fasteners such as nut-and-bolt assemblies, welding, or the like. The open frame may be constructed with any desired suitable arrangement of such support braces 14, as assembled and oriented in an appropriate manner to rigidify the frame and impart thereto sufficient structural integrity for the intended concrete screeding application.

The open frame also comprises a plurality of longitudinally spaced-apart, transversely extending frame supports 23, which are bolted to the respective front and rear screed blades 20 and 22, thereby forming the base of the screed apparatus.

In order to compensate for the tendency of the frame to bend and deflect the screeding surfaces of the respective front and rear screed blades, the camber top member 12 is provided in two adjacent sections as discrete structural elements, each of which may for example be formed by extrusion of aluminum or other suitable material. Each camber top member section is provided with threaded passages in its respective ends receiving complimentarily threaded rods 210 and 212. These threaded rods at the junction of the camber top member sections are in turn coupled by a turnbuckle nut 214 to provide the turnbuckle assembly 208 (FIG. 2). The turnbuckle assembly thus permits adjustment of the relative attitudes of the adjacent camber top member sections, by appropriate adjustment of the turnbuckle nut, whereby the tendency for frame bending and deflection of the screed surfaces may be compensated for.

The screed apparatus of the invention may be provided as a multi-unit structure, in which the elongate frame of open structure comprises a plurality of interconnected separable frame units. FIG. 2 shows the optional coupling of an extension screed unit 10' to the screed apparatus 10 (base unit), by means of the turnbuckle nut 214' joining the adjacent threaded rods extending from the facing ends of the camber top members of the base and extension units, respectively. The extension screed unit 10' may be provided in any desired length, such as for example 2.5 feet, 5 feet, or 10 feet, to provide a multi-unit screed apparatus of desired length. The extension unit 10' thus is constructed similarly to the base unit 10, with the extension unit having respective front and rear blades joined to one another by frame supports, and with the respective screed blades connected to an upper camber top member by suitable bracing.

To effect coupling of the respective screed blades of adjacent units when extension units are employed, the cable pulley assembly comprising pulley 142, and the cable eye-hook assembly comprising eye-hook 140, are removed from the end of the base screed unit 10 and repositioned on the corresponding end of the extension unit. The mechanical fasteners formerly employed to retain the pulley and eye-hook assemblies in position on the base unit then are employed to couple the respective screed blades of the base and extension units to one another.

In such manner, the screed may be provided as a multi-section assembly in which frame units are sequentially attached to one another, to provide exceptionally long concrete screeds up to on the order of 60 feet and longer, as desired. As the length increases, the overall weight of the frame and its associated screed elements will increase. Thus, the tendency for frame bending and deflection of screed surfaces may be compensated for by the use of turnbuckle assemblies between adjacent frame units in the screed, as illustrated in FIG. 2 and as more fully described in our aforementioned copending U.S. patent application Ser. No. 936,480 and our copending U.S. patent application Ser. No. 300,746 filed on Jan. 16, 1987 in the name of Donald R. Morrison and entitled "IMPROVED PORTABLE SCREED."

The frame of the screed has a length which is equal to at least the width of the concrete being screeded. The screed shown in FIGS. 1 and 2 utilizes three main screeding elements.

The first screed blade 20 extends lengthwise of the frame and is connected thereto as previously described. This screed blade is of L-shape comprising a web portion 28 oriented substantially vertically and a screed plate 30 extending substantially horizontally and rearwardly of the web 28. For purposes of orientation, the forward direction of travel of the screed apparatus is indicated by arrow X in FIG. 1.

A second screed blade 22, which may be similar to or different from the construction of the first screed blade 20, is connected to the frame and extends lenthwise thereof, being connected to the frame rearwardly of the first screed blade 20. In the embodiment shown, the second screed blade 22 is constructed similiarly to the first blade 20, being L-shaped with a web 32 extending substantially vertically and a screed plate 34 extending substantially horizontally and rearwardly of the web 32.

In this construction, the second screed plate 34 is generally horizontally aligned with the first screed plate 30.

Mounted on the frame so as to be in close proximity to the first screed plate is a frontal distribution unit, or as referred to hereinafter, a plow body 26. The plow body presents discrete surface portions each longitudinally extending for at least a major portion of the frame length, preferably substantially the entire length of the frame, with the discrete surface portions comprising:

(1) a first generally horizontal surface portion 36, extending forwardly from the vicinity of the first screed plate 30 to a front leading edge and generally horizontally aligned with the first screed plate;

(2) a second surface portion 38 integrally joined to the front leading edge of the first surface portion 36 and extending upwardly therefrom to an upper edge; and (3) a third surface portion 40 which is integrally joined to the upper leading edge of the second surface portion 38 and extends rearwardly upwardly therefrom.

In the embodiment shown in FIGS. 1 and 2, the plow body 26 comprises a fourth surface portion, flange 42, which is integrally joined to the upper end of the third surface portion 40 and extends upwardly rearwardly therefrom, to provide a means of convenient attachment to the frame, by mechanical fasteners 124 and 126 associated with slots 120 and 122, as shown.

The plow body 26 may be formed with the respective surface portions being provided by respective wall members, or the body may be formed as a solid mass, such as by casting, molding, extrusion, etc. In the illustrative embodiment shown, the plow body is formed as a structure in which each of the surface portions is formed by an associated wall member, and with the ends of the plow body being closed by end walls 128, to restrict access of concrete into the interior of the plow body during the screeding operation.

By means of the aforementioned mechanical fasteners 124 and 126 associated with slots 120 and 122, the plow body is mounted on the frame in such manner as to allow vertical adjustability, so that the bottom horizontal surface 36 may be correspondingly positioned above or below the plane of the screen plate 30 of blade 20. The range of such adjustability may for example be as great as two inches, based on a displacement of one inch above to one inch below the plane defined by screed plate 30. The preferred range of adjustability is about one-half inch in each direction, most preferrably about one-fourth inch in each direction.

The exact positioning of the vertically adjustable plow body will depend largely on the rate of travel of the screed in direction X, and the character of the concrete being screeded. For example, in the screeding of very dry concrete, it may be desirable to utilize an elevation with the bottom surface 36 above the plane of screed plate 30, by a vertical distance of about one-fourth inch. Conversely, in the screeding of very wet concrete, it may be desirable to adjust the plow body to a position where the bottom surface 36 is below the plane of screed plate 30, by a distance of about one-fourth inch. It will be recognized that screeding rates and concrete materials may vary widely, and accordingly, that the optimal vertical positioning of the plow body relative to the first screed plate may correspondingly vary in a given use application, as may be readily determined without undue experimentation.

The plow body according to the present invention minimally requires the provision of a first generally horizontal surface portion and a second surface portion integrally joined thereto and extending upwardly therefrom, although the provision of third and fourth surface portions, as previously described, is preferred to effect a particularly high screeding efficiency. Although the second surface portion integrally joined to the front leading edge of the first surface portion of the plow body may extend vertically upwardly or even rearwardly from its junction with the first surface portion, it is especially preferred that the second surface portion extends forwardly upwardly from the front leading edge of the first surface portion, as in the embodiment shown in FIGS. 1 and 2.

The function of the plow body in the screed apparatus of the invention is to classify, rough screed and distribute concrete for the subsequent screeding operations effected by the respective first and second screed plates. By such arrangement, concrete is distributed to prevent its flowing over the first screed blade, i.e., over the upper end of the web 28 of such blade, or otherwise causing the first screed plate to "ride up" over localized accumulations in the mass of concrete being screeded.

With specific reference to FIGS. 1 and 2, the forwardly upwardly extending character of the second surface portion 38 of the plow body causes such surface to direct the concrete it encounters downwardly, for subsequent screeding by the leading and trailing screed plates. Further, any concrete at a height in excess of the capacity of the second surface portion 38 passes onto the upwardly rearwardly inclined third surface portion 40, which provides an extended surface for the retention of the excess concrete, thereby enabling the plow body to "smooth out" fluctuations in the amount of concrete being screeded. In respect of the third surface portion's excess concrete retention function, the upwardly extending flange portion 42 provides additional surface area which further assists such retention function.

In the illustrated embodiment of the invention shown in FIGS. 1 and 2, each of the screed blades is shown as having an L-shape, comprising a horizontal foot portion as the screed plate, and a vertical web. It will be apparent that numerous other screed blade configurations may be employed, comprising generally horizontal screed plates. One such configuration is an inverted T-shaped blade with a generally vertical web, and outwardly extending screed surface feet portions. Many other blade configurations are likewise possible, and accordingly, all such alternative screed blade configurations are to be regarded as being within the scope of the present invention.

The screed shown in FIGS. 1 and 2 features means coupled to the frame for translating the frame along the length of concrete during the screeding operation, to bring the respective screeding elements, viz., the plow body, and the first and second screed plates, into operative screeding engagement with the concrete. The translation means comprise a hydraulically operated winch motor 44. The winch motor has a winch drum 46 attached to its shaft and is actuated by pressurized oil flowed to the winch motor in feed line 178, with the pressurized oil leaving the motor 44 in return line 176. A winching cable 190 is attached to the drum 46 of the winch motor assembly, to provide for winching of the screed apparatus in the direction X as indicated. The winching cable 190 is provided with a slip hook 200 on its front end, to permit attachment of the cable to a suitable stake, tree, or other stationary structure, whereby actuation of the winching motor 44 results in take-up of the cable 190 on the drum 46, so that the screed is propelled in the direction indicated. To assist in the guiding function, the cable is threaded through pulley 188, as attached to the first screed blade 20 in any suitable manner, such as by a mounting plate and nut-and-bolt fastening means.

In like fashion, on the rear portion of the screed unit, there is provided a hydraulic winch motor 62 to which is coupled a rotatable drum 64 on which winching cable 130 is taken up concurrently with the take-up of cable 190 on winching drum 46. The respective winching operations thus involve synchronous take-up of the respective cables, whereby the longitudinal axis of the frame is maintained in perpendicular relationship to the direction of travel indicated by arrow X in FIG. 1.

Winch motor 62 is provided with pressurized oil via feed line 52. The pressurized oil after actuating hydraulic motor 62, leaves the motor in return line 54.

The winch motors 44 and 62 are suitably positioned on the frame on winch motor mounts 58 and 60, respectively. The winch mounts in turn may be joined to the frame of the screed in any suitable manner, such as by welding or the use of mechanical fasteners.

The power supply means for the screed embodiment shown in FIGS. 1 and 2 comprises a gasoline engine 92 mounted on the frame on a suitable frame support which in turn is bolted to the respective front and rear screed blades.

Mounted on the frame supports 23 is a longitudinally extending shaft 24, which may be disposed in bearings 88, as shown. Engine 92 drives the semi-flexible vibrating shaft 24 through a belt 202 attached to the pulley 204 mounted on the vibrating shaft.

The vibrating shaft 24 thus passes through a series of bearings 88 housed in bearing supports as best shown in FIG. 2. The overall vibrating shaft arrangement is preferably of the "loose bearing" form as previously described in applicant's U.S. Pat. No. 4,030,873. Nonetheless, the use of eccentric weights on shaft 24, other vibrators, or the like may be employed instead.

Vibrating shaft 24 is purposely located so that its axis is relatively close to and substantially parallel to the rear screed blade 22, to maximize the vibration of the rear portion of the frame and isolate the front or leading portion of the frame from such vibrations, insofar as is practical. In one embodiment in which the width of the base of the frame, i.e., the distance between the front and rear screed blades, was 30 inches, the shaft was located 10 inches forwardly of the rear screed blade, two-thirds of the distance toward the rear of the assembly.

Coupled with the drive shaft of gasoline engine 92 is a clutch 208 which is operatively coupled to throttle switch 184 (FIG. 1) by means of the throttle cable 186. By such arrangement, the respective drive belts 202 and 206 are disengaged at lower speeds, whereby the motor may be operated with the system "idled" prior to initiation of the active screeding operation.

The aforementioned belt 206 is coupled with the shaft of the gasoline engine 92 as best shown in FIG. 2, and is also coupled to the respective hydraulic pumps 100*a* and 100*b*. These hydraulic pumps and their associated pulley couplings are protectively covered on the forward portion of the screed unit by housing 164.

Hydraulic pumps 100*a* and 100*b* are provided with oil by respective suction lines 160 and 162. Each of the suction lines is joined at a first end to its associated hydraulic pump and at its other end to the oil reservoir 74, which may be filled with oil by means of the oil filler spout 238 provided with a filler cap 240 (FIG. 2).

The oil received from the suction lines 160 and 162 by the hydraulic pumps 100*a* and 100*b*, respectively, is pressurized and discharged from these pumps in respective pressure lines 70 and 72. The pressure line 70 is joined by three-way fitting 174 to feed line 178 of the winch motor 44, and to variable valve 68. Valve 68 in turn is coupled by three-way fitting 172 to the return line 176 from the winch motor 44, and to the return line 168 joined to oil reservoir 74.

In like manner, the pressure line 72 is connected by three-way fitting 180 to the feed line 52 joined to winch motor 62, and to variable valve 66. Valve 66 in turn is connected by the three-way fitting 170 to the discharge line 54 from hydraulic motor 62, and to return line 166 joined to oil reservoir 74.

As indicated, the screed apparatus is provided with a throttle control 184 which may be manually adjusted to provide a predetermined speed of the engine 92, and a resulting faster or slower speed of the hydraulic winch motors 44 and 62, to effect a corresponding faster or slower winching operation. Also wired to the throttle control is a "kill" button 182, which may be employed to shut off engine 92 when the screeding operation has been completed, or its cessation is desired.

In order to preserve the longitudinal alignment of the screed apparatus in operation, an alignment assembly is employed which comprises coaxial telescoping tubes 148 and 152. The outer telescoping tube 152 is provided with mounting flanges 216 and 218, by which such tube may be joined by mechanical fasteners to the respective front and rear screed blades 20 and 22.

The inner telescoping tube 148 is provided with a series of openings 150 along its side surfaces, by which the relative positions of the coaxial tubes may be fixed by means of a quick pin 154. The legs of the quick pin 154 pass through openings in the outer tube 152, and into the side openings of the inner tube 148 in register with the outer tube openings. In such manner, by removal and reinsertion of the quick pin 154, inner tube 148 may be retracted into or extended rearwardly from the outer tube 152.

At the rear extremity of the inner tube 148 is mounted a pulley 146. The outer surface of this pulley engages the winching cable 130. Cable 130 thus passes from spool 64, as previously described, through the guide pulley 226 attached by fitting 228 to the coupling ring 230. The coupling ring 230 is joined to an outwardly extending flange portion of the pulley mounting bracket 232. The pulley mounting bracket 232 is affixed to the second screed plate 22 by mechanical fasteners 234 and 236, which may suitably comprise nut-and-bolt assemblies.

At the opposite end of the screed, cable 130 after being engaged by the outer surface of pulley 146 passes through pulley 142. Pulley 142 is mounted on the second screed plate 22 by means of mounting bracket 220 and mechanical fasteners 222 and 224. After being engaged by the pulley 142, cable 130 extends forwardly through the eye hook 140 of the eye hook assembly comprising mounting bracket 134. The mounting bracket is attached to the first screed plate 20 by means of mechanical fasteners 136 and 138, such as nut-and-bolt assemblies.

In like manner to the winch cable previously described, cable 130 may be provided at its forward end with a slip hook 132 for attachment to a stake, tree, or other stationary structure, toward which the screed apparatus may be forwardly drawn, in the direction X. As previously indicated, the hydraulic winch motors 44 and 62 are synchronously driven, to effect a uniform forward velocity of the screed apparatus, and to keep the longitudinal axis of the screed apparatus generally perpendicular to the forward travel direction X, as shown in FIG. 1.

It will thus be seen that the provision of the alignment means comprising the above-described telescoping tube assembly will, in combination with the camber top coupling assembly 208, provide a desired alignment of the screed apparatus, and resist deflection or deviation from the desired alignment profile of the apparatus in use.

Further, when the base unit shown in FIGS. 1 and 2 is attached to one or more extension screed units, e.g., extension unit 10' as shown in FIG. 2, the apparatus is appropriately modified by detachment of the mounting brackets associated with pulley 142 and eye hook 140, and repositioning of these brackets on the corresponding end of the outermost extension unit. The telescoping tube assembly is likewise detached from the front and rear screed blades, and repositioned along the multi-unit frame of the screed apparatus at a position which is intermediate, preferably more or less central, with respect to the length dimension of the screed apparatus.

By such arrangement, the inner telescoping tube 148 may be appropriately positioned to exert a selected tension on the cable 130, so that the intermediate portion of the multi-unit frame is maintained in alignment with its respective ends, to counteract deviations in alignment which may result from (a) the extended length of the apparatus, and/or (b) fluctuations in the amount of concrete being contacted along the length of the screed apparatus in operation.

In multiple frame unit screeds, the extension units may be coupled to the base unit and/or to one another by appropriate mechanical fastening of the respective first and second screed blades of adjacent units to one another, preferably with the use of camber adjustment turnbuckle nuts 214', as shown in FIG. 2. In such multi-unit screeds, the semi-flexible shaft segments of adjacent units may be intercoupled in any suitable fashion, such as by the use of collars containing set screws which mate with respective key openings in the end portions of the shafts on adjacent frame units.

Figure 3:
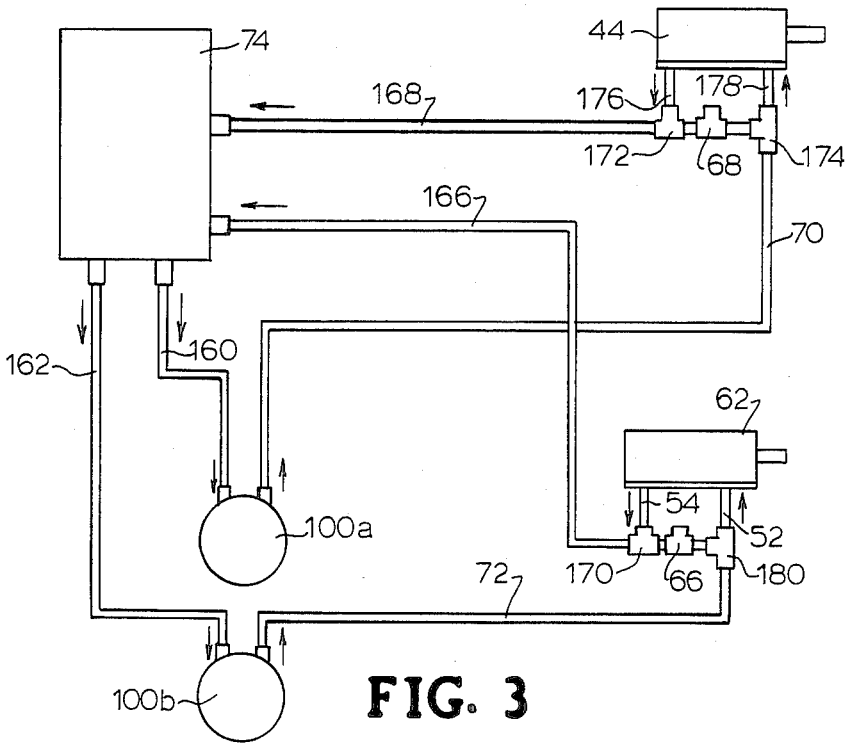
FIG. 3 is a schematic diagram of the hydraulic system of the FIGS. 1 and 2 screed apparatus.

FIG. 3 shows a schematic diagram of the hydraulic system employed in the screed apparatus shown in FIGS. 1 and 2, and in which the various system elements are numbered correspondingly to the earlier-described drawings.

The operation of the hydraulic system now will be described with reference to FIGS. 1–3, it being understood that the engine 92 is in operation and the clutch 208 engaged to actuate the hydraulic pumps **100*a* and 100*b*** during such hydraulic system operation.

Reservoir 74, which may have a liquid volume capacity of approximately 0.6 gallons, provides oil to hydraulic pump **100*a* in suction line 160, and to hydraulic pump 100*b* in suction line 162. The oil which is pressurized in hydraulic pump 100*a* is discharged therefrom in pressure line 70. From pressure line 70 the oil is directed through the three-way fitting 174 to pressure line 178 and/or return line 168, depending on the position of the variable valve 68. Valve 68** may be a variable needle valve or other suitable valve, which is adjustable so that the level of oil flow through the respective pressure and/or return lines is controlled in response to the valve setting.

With valve 68 in its fully closed position, all oil from pressure line 70 is directed through pressure line 178 to the hydraulic motor 44, from which it is returned through line 176, three-way fitting 172, and return line 168, to reservoir 74. If the valve 68 is fully open, substantially all oil from pressure line 70 is directed through the valve body to return line 168, so that the winch motor 44 is not actuated. Between these extreme positions, the valve is variably manually settable, so that the speed of the winch motor 44, which is proportional to the flow rate of oil therethrough, may be regulated to obtain a desired winching speed in operation.

In like manner, depending on the position of variable valve 66, pressurized oil is discharged from hydraulic pump **100*b* in pressure line 72 and may be flowed (a) through three-way fitting 180, pressure line 52, hydraulic motor 62, discharge line 54, three-way fitting 170, and return line 166, and/or (b) through three-way fitting 180, valve 66, three-way fitting 170, and return line 166, to the reservoir 74. Accordingly, the relative position of valve 66 may be adjusted to regulate the speed of hydraulic motor 62** and thereby provide a desired winching speed in operation.

Figure 4:
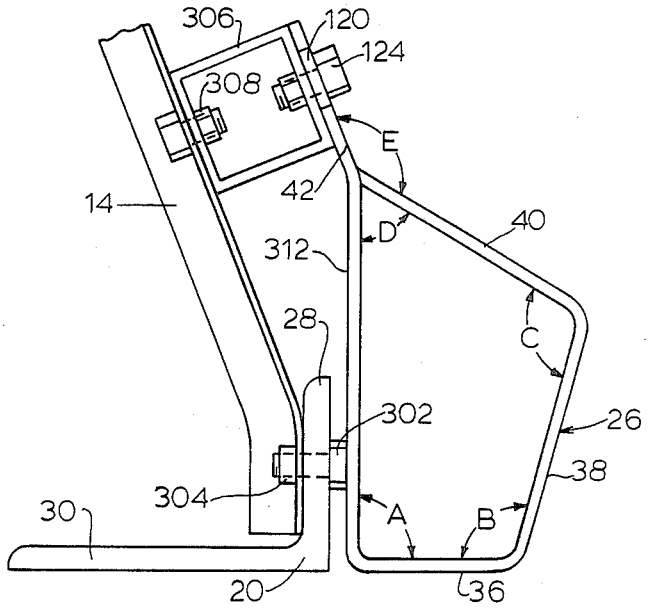
FIG. 4 is a cross-sectional elevation view of the leading portion of the screed apparatus of FIGS. 1–2, showing the details of construction of the frontal distribution unit.

FIG. 4 is a cross-sectional elevation view of a frontal portion of the screed apparatus shown in FIGS. 1–2, illustrating the details of construction of the plow body 26. The brace 14 of the frame is angularly bent to provide a substantially vertical lower portion as shown, to which the vertical web 28 of the screed blade 20 is attached by a mechanical fastener comprising bolt 302 and nut 304. The substantially horizontal screed plate 30 is integrally attached to the vertical web 28.

Above this junction of the frame brace 14 and screed blade 20, a box beam 306 is secured to the brace by bolt and nut fastener 308. The flange portion 42 of the plow body 26 is joined to the front face of the box beam 306 by bolt and nut fastener 124. As previously described, the relative vertical position of the plow body 26 may be adjusted by repositioning the mechanical fastener 124 along the vertical extent of slot 120, as desired.

By this arrangement, the back wall 312 of the plow body is maintained in a substantially vertical orientation, and is in slightly spaced relationship to the first screed blade 20, as a result of the head of the bolt 302 being interposed between the rear wall 312 and the web 28 of screed blade 20.

FIG. 4 also shows the various included angles between the respective surface portions of the plow body. As previously described, the various surface portions of the plow body may be provided by respective wall members, whereby the various wall members enclose a hollow volume within the body, which may be fully enclosed such as by the end walls 128 shown in FIG. 1. Alternatively, the screed body may be formed as a solid piece, or in other suitable manner providing at least the aforementioned first and second surface portions.

In the construction shown in FIG. 4, the rear wall 312 and the first surface portion 36 of the plow body define an included angle A which preferably is 90°. The included angle B between the first surface portion 36 and the second surface portion 38 may suitably be on the order of 110°, being broadly within the range of from about 90° to about 145°, and more preferably between about 100° and 130°.

The included angle between the second surface portion 38 and the third surface portion 40, angle C, may also be on the order of 110°, and more broadly within a preferred range of from about 90° to about 130°, and most preferably within a range from about 100° to about 120°.

The included angle D between the third surface portion 40 and the rear wall 312 of the plow body may suitably be on the order of about 70°, and is preferably in the range of about 45° to about 80°. The included angle E between the third surface portion 40 and the flange portion 42 of the plow body may suitably be on the order of about 160°, and is preferably within the range of from about 120° to about 180°.

In the above-described illustrative embodiment in which the angle A equals 90°, B equals 110°, C equals 110°, D equals 70°, and E equals 160°, the first surface portion 36 (all dimensions hereinafter referred to are the lengths of the respective surface portions measured on a cross-section of the apparatus as shown in FIG. 4) was about 2.5 inches, the second surface portion 38 was about 4 inches, the third surface portion was about 4 inches, and the flange portion 42 was about 2.75 inches. In such embodiment, the rear wall 312 of the plow body was on the order of about 6 inches and the lateral spacing between the plow body 26 and the screed blade 20 was on the order of $\frac{3}{8}$–$\frac{1}{2}$ inch. The web of the screed blade 20 in this embodiment had a height of about 3 inches, and the screed plate 30 was about 5 inches in length, as measured from the junction of the plate with web 28 to the rear edge of such plate. The wall members forming the plow body in this embodiment were approximately $\frac{3}{8}$ inch in thickness, and were constructed of aluminum.

Figure 5:
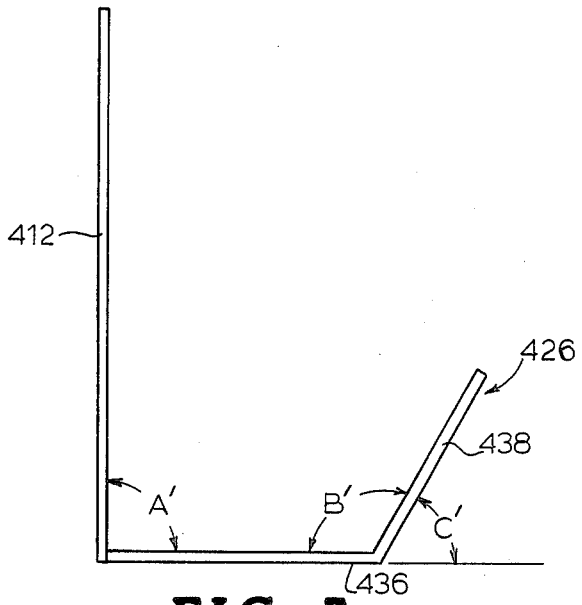
FIG. 5 is a cross-sectional elevation view of an alternative frontal distribution unit for a screed apparatus according to the present invention.

FIG. 5 shows an alternative embodiment of the plow body which has potential utility in the practice of the invention. This plow body 426 comprises a first surface portion 436 joined to a second surface portion 438, these respective surface portions being provided by an integrally formed wall element. The rear edge of the first surface portion 436 in this construction is joined to rear wall 412, e.g., by welding, or integral formation therewith such as by casting, molding, extrusion, etc. In this embodiment, the respective included angles A′ and B′ may be within the ranges previously described for the angles A and B in FIG. 4, with the external angle C′, between the front face of the second surface portion 438 and the surface of the screeded concrete, being the complement of angle B′. External angle C′ thus may be on the order of from about 35° to about 90°, preferably from about 50° to about 80°.

The plow body embodiment shown in FIG. 5 provides the same operative features and advantages as provided by the corresponding first and second surface portions in the FIG. 4 embodiment, but lacks the third surface portion and the flange portion utilized in such earlier-described embodiment. As indicated, it is generally preferred in practice to utilize such third surface and flange portions, thereby providing an extended retention surface for damping fluctuations in the amount of concrete being screeded. With such extended area surfaces, excess concrete, above the amount accommodatable by the first and second surface portions, is retained on the third surface portion and, if necessary, the flange portion, until the amount of concrete being screeded has been reduced to a level which is accommodatable by the first and second surface portions.

Accordingly, if a retention surface or surfaces is required in an embodiment of the general type shown in FIG. 5, the plow body may be modified by inclusion of appropriate structure to effect such retention function. For example, it may be advantageous to deploy a concavely curved wall between the upper end of second surface portion 438 and an upper part of rear wall 412.

Figure 6:
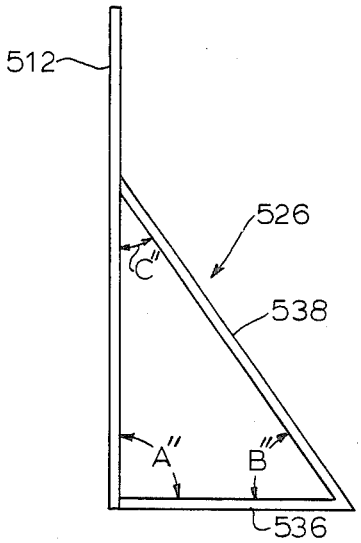
FIG. 6 is a cross-sectional elevation view of another alternative frontal distribution unit potentially useful in the practice of the present invention.

FIG. 6 shows still another configuration of a plow body such as may be potentially employed in the broad practice of the present invention. As shown, the plow body 526 comprises a first surface portion 536 joined to a rear wall 512 to form an included angle A″, which may be on the order of about 90°. The first surface portion 536 is integrally joined to a second surface portion 538 in such manner as to define an included acute angle B″ which may be in the broad range of about 25° to about 65°. The second wall portion thus is joined to the front leading edge of first surface portion 536 and extends upwardly rearwardly therefrom, being joined at its upper end to the rear wall 512. In such manner, the second surface portion 526 forms an included angle C″ with rear wall 512, which may be in the broad range of from about 25° to about 65°, it being understood that when angle A″ is a right angle, i.e., 90°, angles B″ and C″ will be angular complements of one another, i.e., their sum will be 90°.

Relative to the plow body embodiments shown in FIGS. 4 and 5, the FIG. 6 configuration features a second surface portion which is rearwardly upwardly extending, as opposed to the forwardly upwardly extending second surface portions in the embodiments of FIGS. 4 and 5. As a result, the plow body shown in FIG. 6 does not have a forwardly upwardly extending surface to provide a downwardly directing action on the concrete being screeded, as in the embodiments of FIGS. 4 and 5. Nonetheless, the FIG. 6 embodiment does provide an extended surface area by means of second surface portion 538 and the frontal face of rear wall 512 above its junction with the second surface portion 512, for retention of excess concrete during the screeding operation. Thus, the weight of excess concrete retained on the retention faces of the second surface portion 526 and the frontal surface of the rear wall 512, provides a downwardly directed action on the concrete, as a result of the influence of gravity on the mass of concrete retained on these surface portions.

It will be appreciated that many other configurations of the plow body are possible within the broad scope of the invention, encompassing many different potentially useful arrangements of constituent surface portions and angular relationships between such surface portions.

It also will be appreciated that the provision of a screed having a plow body of the character described is highly beneficial in facilitating a high speed, high-efficiency screeding operation, in which the applied concrete is directed by the plow body to the leading and trailing screed plates in succession, to achieve a rapid application to the concrete of a screeded surface, and a high level of consolidation of the concrete in the screeding operation.

Further, although preferred embodiments of the present invention have been described in detail, it will be apparent that other variations, modifications, and embodiments are possible, and accordingly all such variations, modifications, and embodiments are to be regarded as being within the spirit and scope of the invention.

What is claimed is:

1. A concrete screed, comprising:

(a) an elongate frame;

(b) at least one screeding surface element connected to said frame;

(c) first and second winching mechanisms mounted on said frame at a first end portion thereof;

(d) a power source mounted on said frame and operatively coupled to said winching mechanisms to effect winching, whereby said frame may be translated in a selected direction;

(e) a first cable jointed to said first winching mechanism for take-up of said first cable thereon when said first winching mechanism is actuated by said power soruce, said first cable at its free end extending forwardly of said frame at said first end portion thereof;

(f) a second cable joined to said second winching mechanism for take-up of said second cable when said second winching mechanism is actuated by said power source, said second cable being rearwardly positioned and extending along the length of said frame from said second winching mechanism at said first end portion thereof to an opposite, second end portion of the frame, and at its free end extending forwardly of said frame at said second end portion thereof;

(g) guide means attached to said frame at said second end portion thereof and coupled with said second cable to allow free travel of said second cable during said winching; and (h) adjustable means mounting a pulley over which said second cable travels and located rearwardly and intermediate of the length of said frame for adjustably imparting a selected tension to said second cable operative to oppose misalignment of said frame during said winching, whereby said first and second end portions of said frame are maintainable in selected alignment with one another during winching of said screed.

2. A concrete screed according to claim 1 in which said adjustable tensioning means comprise: coaxial telescoping tubular members including an outer tubular member and an inner tubular member, said outer tubular member being mounted on said frame at an intermediate portion of the frame, and said inner tubular member being longitudinally slideable in said outer tubular member; a pulley at the outer end of said inner tubular member for engaging said second cable in free traveling relationship therewith; and means for fixably positioning said inner tubular member relative to said outer tubular member in a rearwardly extending position with said pulley bearing against said second cable in selected tensioning relationship therewith.

3. A concrete screed as claimed in claim 1 wherein said power source includes an engine driven hydraulic pumping-motor system mounted on said frame for operating said winching mechanisms.

4. A vibrating concrete screed, comprising:

(a) an elongate open structure frame in the form of a triangle in cross section including first and second spaced apart screed plates positioned at the lower corners of said triangle and adapted to engage and level concrete as said screed is moved over the concrete, a top member positioned at the top corner of said triangle and cross braces fixed to and extending between said screed plates and top member;

(b) a plow body mounted on the frame in close proximity to said first screed plate and presenting discrete surface portions each longitudinally extending for at least a major portion of the frame length, said discrete surface portion comprising:

(i) a first generally horizontal surface portion, extending forwardly from the vicinity of the first screed plate to a front leading edge and generally horizontally aligned with said first screed plate; and (iii) a second surface portion integrally joined to said front leading edge of said first surface portion and extending upwardly therefrom to an upper edge;

(c) first and second hydraulically motor-operated winching mechanisms mounted on said frame;

(d) a power source including a gasolone engine supported within and on the base portion of said frame and a hydraulic pumping—motor system driven by said engine and operatively coupled to said winching mechanisms to effect winching of said frame in a selected direction;

(e) a vibrating mechanism including bearings mounted on said frame between said blades and spaced inwardly from each end of said frame, a shaft supported for rotation in said bearings and extending throughout the length of said frame and structural means associated with said shaft designed upon rotation of said shaft to allow said shaft to vibrate said frame and means powered by said engine for driving said shaft.

(f) a first cable joined to said first winching mechanism for takeup of said first cable thereon when said first winching mechanism is actuated by said power source, said first cable at its free end extending forwardly of said frame at a first end portion thereof;

(g) a second cable joined to said second winching mechanism for take-up of said second cable when said second winching mechanism is actuated by said power source, said second cable being rearwardly positioned and extending along the length of said frame from said first end portion thereof to an opposite, second end portion of the frame, and at its free end extending forwardly of said frame at said second end portion thereof;

(h) guide means attached to said frame at said second end portion thereof and coupled with said second cable to allow free travel of said second cable during said winching; and (i) adjustable means mounting a pulley over which said second cable travels and located rearwardly and intermediate of the length of said frame for adjustably imparting a selected tension to said second cable operative to oppose misalignment of said frame during said winching, whereby said first and second end portions of said frame are maintainable in selected alignment with one another during winching of said screed.

5. A vibrating concrete screed as claimed in claim 4 wherein said first and second winching mechanisms are both mounted on said first end portion of said frame.

* * * * *

UNITED STATES PATENT AND TRADEMARK OFFICE

CERTIFICATE OF CORRECTION

PATENT NO. : 4,722,638

DATED : February 2, 1988

INVENTOR(S) : Donald R. Morrison

It is certified that error appears in the above-identified patent and that said Letters Patent is hereby corrected as shown below:

Column 13, line 9, correct "jointed" to read --joined--.

Column 13, line 12, correct "soruce" to read --source--.

Signed and Sealed this

Second Day of August, 1988

*Attest:*

DONALD J. QUIGG

*Attesting Officer*

*Commissioner of Patents and Trademarks*